US006715644B2

(12) United States Patent
Wilford

(10) Patent No.: US 6,715,644 B2
(45) Date of Patent: Apr. 6, 2004

(54) FLEXIBLE PLASTIC CONTAINER

(75) Inventor: Michael Wilford, Downers Grove, IL (US)

(73) Assignee: David S. Smith Packaging Limited, London (GB)

( * ) Notice: Subject to any disclaimer, the term of this patent is extended or adjusted under 35 U.S.C. 154(b) by 0 days.

(21) Appl. No.: 10/037,295

(22) Filed: Dec. 21, 2001

(65) Prior Publication Data

US 2003/0089737 A1 May 15, 2003

Related U.S. Application Data

(60) Provisional application No. 60/332,463, filed on Nov. 9, 2001.

(51) Int. Cl.[7] ..... B65D 35/28

(52) U.S. Cl. ..... 222/95; 222/547; 222/564; 222/107

(58) Field of Search ..... 222/105, 107, 222/95, 547, 565, 566, 564; 383/100, 105

(56) References Cited

U.S. PATENT DOCUMENTS

| | | | |
|---|---|---|---|
| 336,826 | A | 2/1886 | Steenken |
| 972,095 | A | 10/1910 | Booth |
| 1,109,110 | A | 9/1914 | Clark |
| 1,884,215 | A | 2/1932 | Edwards |
| 2,024,908 | A | 12/1935 | Blum |
| 2,027,290 | A | 1/1936 | Reach |
| 2,106,671 | A | 1/1938 | Watson |
| 2,116,009 | A | 5/1938 | Brown |
| 2,133,411 | A | 10/1938 | Zohe |
| 2,196,708 | A | 4/1940 | Reid |
| 2,477,300 | A | 7/1949 | Karfiol et al. |
| 2,569,975 | A | 10/1951 | Cone |
| 2,643,027 | A | 6/1953 | Fink |
| 2,659,516 | A | 11/1953 | Smith |
| 2,672,268 | A | 3/1954 | Bower |
| 2,697,635 | A | 12/1954 | Ivins et al. |
| 2,714,557 | A | 8/1955 | Mahaffy |
| 2,731,297 | A | 1/1956 | Meyer |
| 2,736,468 | A | 2/1956 | Hills |

(List continued on next page.)

FOREIGN PATENT DOCUMENTS

| | | |
|---|---|---|
| CH | 247934 | 4/1946 |
| DE | 1761403 | 5/1967 |
| DE | 2332927 | 9/1984 |
| FR | 724974 | 10/1931 |
| FR | 1074166 | 2/1953 |
| GB | 732761 | 6/1955 |
| GB | 756093 | 8/1956 |
| GB | 1 473 524 | 5/1977 |
| WO | 83/01605 | 5/1983 |
| WO | 85/04383 | 10/1985 |
| WO | WO 01/36276 | 5/2001 |
| WO | 01/36276 A2 | 5/2001 |

OTHER PUBLICATIONS

Brubaker et al. "The Coil Test and Neutrophil Stimulation Pack" (1977).

*Primary Examiner*—Edward K. Look
*Assistant Examiner*—John K. Fristoe, Jr.
(74) *Attorney, Agent, or Firm*—Joseph A. Fuchs; Bell Boyd & Lloyd LLC

(57) ABSTRACT

A flexible polymeric container for storing and dispensing liquids includes a first sidewall and a second sidewall connected together to define a fluid chamber therebetween. The first sidewall and the second sidewall each have an inner surface facing the fluid chamber and an opposed outer surface. A fitment is attached to an outer surface of one of the first sidewall or the second sidewall. The fitment has an opening therethrough which has an axis substantially perpendicular to the outer surface. A plurality of objects on the inner surface of one of the first sidewall or the second sidewall defines a plurality of pathways having at least a first pathway and a second pathway intersecting one another.

5 Claims, 2 Drawing Sheets

U.S. PATENT DOCUMENTS

| | | | |
|---|---|---|---|
| 2,778,171 | A | 1/1957 | Taunton |
| 2,778,173 | A | 1/1957 | Taunton |
| 2,804,257 | A | 8/1957 | Hasler et al. |
| 2,809,800 | A | 10/1957 | Ahl |
| 2,859,899 | A | 11/1958 | Kramer et al. |
| 2,862,648 | A | 12/1958 | Cooksley et al. |
| 2,870,954 | A | 1/1959 | Kulesza |
| 2,885,084 | A | 5/1959 | Rocca |
| 2,891,700 | A | 6/1959 | Maynard |
| 2,920,798 | A | 1/1960 | Samuel |
| 3,063,461 | A | 11/1962 | Rudolph |
| 3,081,911 | A | 3/1963 | Scholle |
| 3,083,875 | A | 4/1963 | Welty et al. |
| 3,090,526 | A | 5/1963 | Hamilton et al. |
| 3,110,754 | A | 11/1963 | Witort et al. |
| 3,112,047 | A | 11/1963 | Weinreich et al. |
| 3,142,599 | A | 7/1964 | Chavannes |
| 3,171,571 | A | 3/1965 | Daniels |
| 3,176,727 | A | 4/1965 | Rousseau |
| 3,197,073 | A | 7/1965 | Gondra et al. |
| 3,203,026 | A | 8/1965 | Schwartzman |
| 3,204,825 | A | 9/1965 | Underwood |
| 3,212,681 | A | 10/1965 | Weikert |
| 3,219,240 | A | 11/1965 | Campbell, Jr. |
| 3,240,399 | A | 3/1966 | Frandeen |
| 3,244,576 | A | 4/1966 | Swartz |
| 3,254,828 | A | 6/1966 | Lerner |
| 3,257,036 | A | 6/1966 | Micallef |
| 3,260,412 | A | 7/1966 | Larkin |
| 3,334,659 | A | 8/1967 | Magorien |
| 3,342,377 | A | 9/1967 | Peredy |
| 3,361,303 | A | 1/1968 | Jacuzzi |
| 3,366,284 | A | 1/1968 | Marona |
| 3,367,380 | A | 2/1968 | Dickey |
| 3,411,698 | A | 11/1968 | Reynolds |
| 3,420,413 | A | 1/1969 | Corsette |
| 3,456,850 | A | 7/1969 | Uhlmann |
| 3,469,796 | A | 9/1969 | Guenther |
| 3,549,050 | A | 12/1970 | Bruce et al. |
| 3,587,794 | A | 6/1971 | Mattel |
| 3,666,182 | A | 5/1972 | Cureton |
| 3,695,314 | A | 10/1972 | Watts et al. |
| 3,718,236 | A | 2/1973 | Reyner et al. |
| 3,799,914 | A | 3/1974 | Schmit |
| 3,809,217 | A | 5/1974 | Harrison |
| 3,838,794 | A | 10/1974 | Cogley et al. |
| 3,881,519 | A | 5/1975 | Zahid |
| 3,902,516 | A | 9/1975 | Rudolph |
| 3,946,780 | A | 3/1976 | Sellers |
| 3,958,693 | A | 5/1976 | Greene |
| 3,981,415 | A | 9/1976 | Fowler et al. |
| 3,988,499 | A | 10/1976 | Reynolds |
| 4,014,461 | A | 3/1977 | Harvill |
| 4,015,819 | A | 4/1977 | Zahid |
| 4,041,209 | A | 8/1977 | Scholle |
| 4,062,475 | A | 12/1977 | Harris et al. |
| 4,087,026 | A | 5/1978 | Petterson |
| 4,093,068 | A | 6/1978 | Smrt |
| 4,137,930 | A | 2/1979 | Scholle |
| 4,138,036 | A | 2/1979 | Bond |
| 4,148,416 | A | 4/1979 | Gunn-Smith |
| 4,150,696 | A | 4/1979 | Meier et al. |
| 4,152,184 | A | 5/1979 | Bacehowski |
| 4,159,790 | A | 7/1979 | Bailey |
| 4,193,518 | A | 3/1980 | Holmes |
| 4,214,675 | A | 7/1980 | Schmit |
| 4,224,367 | A | 9/1980 | Scholle |
| 4,257,535 | A | 3/1981 | Mellett |
| 4,258,863 | A | 3/1981 | Ness |
| 4,265,373 | A | 5/1981 | Stoody |
| 4,266,692 | A | 5/1981 | Clark |
| 4,269,884 | A | 5/1981 | Della Vecchia et al. |
| 4,270,533 | A | 6/1981 | Andreas |
| 4,275,823 | A | 6/1981 | Credle, Jr. |
| 4,284,671 | A | 8/1981 | Cancio et al. |
| 4,286,636 | A | 9/1981 | Credle |
| 4,322,020 | A | 3/1982 | Stone |
| 4,326,574 | A | 4/1982 | Palaroni et al. |
| 4,362,255 | A | 12/1982 | Bond |
| 4,375,864 | A | 3/1983 | Savage |
| 4,381,646 | A | 5/1983 | Ruseff et al. |
| 4,445,539 | A | 5/1984 | Credle |
| 4,445,550 | A | 5/1984 | Davis et al. |
| 4,449,243 | A | 5/1984 | Platel |
| 4,484,697 | A | 11/1984 | Fry, Jr. |
| 4,513,884 | A | 4/1985 | Magid |
| 4,524,458 | A | 6/1985 | Pongrass et al. |
| 4,551,379 | A | 11/1985 | Kerr |
| 4,576,283 | A | 3/1986 | Fafournoux |
| 4,579,756 | A | 4/1986 | Edgel |
| 4,600,130 | A | 7/1986 | Libit |
| 4,601,410 | A | 7/1986 | Bond |
| 4,683,702 | A | 8/1987 | Vis |
| 4,815,631 | A | 3/1989 | Eeg et al. |
| 4,893,731 | A | 1/1990 | Richter |
| 5,024,354 | A | 6/1991 | Ledewiz |
| 5,147,071 | A | 9/1992 | Rutter et al. |
| 5,232,535 | A | 8/1993 | Brinley |
| 5,385,564 | A | 1/1995 | Slater et al. |
| RE34,929 | E | 5/1995 | Kristen |
| 5,647,511 | A | 7/1997 | Bond |
| 5,728,086 | A | 3/1998 | Niedospial, Jr. |
| 5,749,493 | A | 5/1998 | Boone et al. |
| 5,915,596 | A | 6/1999 | Credle, Jr. |
| 5,928,762 | A | 7/1999 | Aizawa et al. |
| 5,941,421 | A | 8/1999 | Overman et al. |
| 6,012,611 | A | 1/2000 | Schroeder |
| 6,045,006 | A | 4/2000 | Frazier et al. |
| 6,102,252 | A | 8/2000 | Overman et al. |
| 6,179,173 | B1 | 1/2001 | Frazier et al. |
| 6,223,981 | B1 | 5/2001 | Gunder |
| 2003/0127178 | | 7/2003 | Anderson et al. |
| 2003/0136798 | | 7/2003 | Wilford |

FLEXIBLE PLASTIC CONTAINER

RELATED APPLICATIONS

This application is a continuation-in-part of U.S. Provisional Patent application Ser. No. 60/332,463 filed on Nov. 9, 2001 which is incorporated herein by reference and made a part hereof.

TECHNICAL FIELD

The present invention relates generally to a flexible plastic container and more particularly to a flexible container for directing a flowable material contained therein to a fitment of the container and dispensing the flowable material.

BACKGROUND OF THE INVENTION

Collapsible plastic bags are often used to store liquid products such as chemicals, soft drink syrup, fruit juices and food condiments. The plastic bags are typically housed in a corrugated paperboard box to aid in the transporting, handling and dispensing of the product. Such packaging systems are commonly referred to as "bag-in-box" packaging systems.

The plastic bags typically have sidewalls sealed along a peripheral seam to define a fluid containing chamber. A spout or a fitment provides access to the fluid chamber for filling and dispensing the product within the bag. Vacuum pump systems are sometimes connected to the container to assist in draining fluid from the container. Both gravity dispensing bags and vacuum pump systems suffer from the common drawback that fluid may become trapped within the folds of the bag during draining. Because of this, evacuation channels are often placed within the bag. Evacuation channels are typically elongate cylindrical tubes or flat strips with protruding ribs defining grooves. Typically, one end of the evacuation channel is disposed transverse to, or is connected to the spout, and the other end of the evacuation channel extends into the fluid containing chamber of the bag. As the bag is emptied by the force of the vacuum pump, or by the force of gravity, portions of the bag collapse unevenly, tending to leave pockets of product, typically liquid, which may become isolated from the rest of the liquid in the container. The evacuation channel, however, forms a conduit which cannot be closed off by the folds created in the bag. In this manner the entire chamber of the flexible bag remains in communication with the spout at all times during the dispensing such that all product within the bag can be removed.

Prior attempts to provide such bags are disclosed in U.S. Pat. Nos. 4,601,410; 5,647,511 and 5,749,493. U.S. Pat. Nos. 4,601,410 and 5,647,511 disclose a liquid container with an evacuation unit. In both the '410 and '511 patents, the evacuation unit is shown attached directly to the spout by a mounting ring. Several problems have been encountered with these types of evacuation units. For example, during the filling process, which is typically done in a high speed and high pressure process, the evacuation unit is susceptible of being dislodged from the spout thereby rendering the evacuation unit inoperative. Also, the attaching ring can impede the flow of liquid during the filling process thereby slowing the filling process.

U.S. Pat. No. 5,749,493 discloses an evacuation unit positioned within a bag and transverse and perpendicular to a spout in the bag. Because the evacuation unit is positioned in a location that is in line with the incoming fluid during the filling process, it is susceptible of being dislodged from its mounting to the container thereby rendering it ineffective. The '493 Patent also discloses extruding a pair of ribs or a single rib or protuberance extending the length of the container.

Many of the designs which utilize an evacuation unit positioned within the bag require that the unit be placed into the bag after the bag has been substantially constructed. This is highly undesirable because it adds another step to the manufacturing process and increases the labor costs.

U.S. Pat. No. Re. 34,929 discloses a plastic bag having interconnected air channels on its inner surface for the vacuum packaging of perishable items. The air channels are formed by the spaces between a plurality of raised protuberances having uniform thickness and formed in a generally regular and waffle-like pattern. The protuberances prevent the total collapse of the bag during air evacuation. There is no disclosure to utilize a fitment to provide access to the contents of the container. There is also no disclosure of removing the stored contents of the bag, but, rather only removing air from the package to prevent spoilage of the perishable item contained therein.

U.S. Pat. No. 2,778,171 discloses the production of airtight packages for packaging perishable items such as food. Projections are provided near an opening of the airtight package for keeping sidewalls of the container from fully collapsing against one another while air is being evacuated from the container. There is no disclosure of evacuating a stored product from the container and no disclosure of providing a fitment with the bag to provide access to the stored contents.

U.S. Pat. No. 5,728,086 discloses a flexible container having multiple access ports and particularly discloses a container for storing fluids for parenteral administration to a patient. An inner surface of a sidewall of the container can have various patterns embossed thereon to assist in draining the contents of the container.

SUMMARY OF THE INVENTION

The present invention provides a flexible polymeric container for storing and dispensing liquids. The container has a first sidewall and a second sidewall connected together to define a fluid chamber therebetween. The first sidewall and the second sidewall each have an inner surface facing the fluid chamber and an opposed outer surface. A fitment is attached to an outer surface of one of the first sidewall or the second sidewall, the fitment having an opening therethrough having an axis substantially perpendicular to the outer surface. A plurality of objects are positioned on the inner surface of one of the first sidewall or the second sidewall to define a plurality of pathways having at least a first pathway and a second pathway intersecting one another.

The present invention further provides a flexible polymeric container for storing and dispensing liquids. The container has a first sidewall and a second sidewall connected together to define a fluid chamber therebetween, the first sidewall and the second sidewall each having an inner surface facing the fluid chamber and an opposed outer surface and an access member for accessing the fluid chamber. A plurality of a first set of objects having a first shape is positioned on the inner surface of one of the first sidewall or the second sidewall. A plurality of a second set of objects having a second shape different from the first shape is positioned on the inner surface of one of the first sidewall or the second sidewall.

The present invention further provides a method for evacuating a fluid from a container. The method includes the steps of: (1) providing a liquid filled container having a sidewall having an inner surface and an outer surface, (2) providing a plurality of objects on the inner surface of the sidewall to define a plurality of pathways having at least a first channel and a second channel intersecting one another; (3) providing a fitment attached to the outer surface, the fitment having an opening therethrough having an axis substantially perpendicular to the outer surface; and (4) applying a suction to the fitment to draw fluid from the container.

DETAILED DESCRIPTION

While this invention is susceptible of embodiment in many different forms, herein will be described in detail with the accompanying figures, a preferred embodiment of the invention. The present disclosure is to be considered as an exemplification of the principles of the invention and is not intended to limit the broad aspect of the invention to the embodiments illustrated and described.

Figure 1:
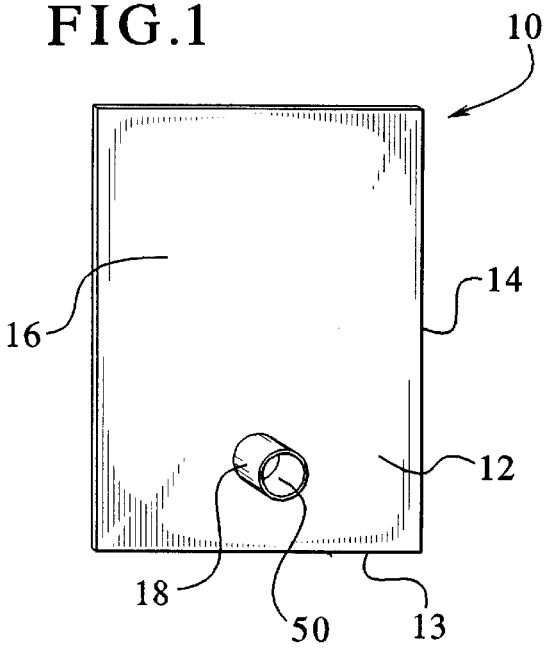
FIG. 1 is a perspective view of a container having a fitment.
Figure 2:
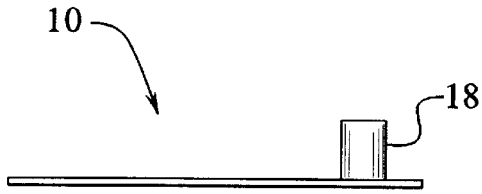
FIG. 2 is a side view of the container of FIG. 1.

FIGS. 1 and 2 show a flexible container assembly 10 having a first sidewall 12 and a second sidewall 13 attached at peripheral edges 14 to define a fluid tight chamber 16. A spout 18 is attached to an outer surface of the sidewall 12 and provides fluid flow access to the chamber 16. In a preferred form of the invention, the first and second sidewalls 12 and 13 are a flexible polymeric material having a modulus of elasticity of less than 50,000 psi. The sidewalls preferably are made from materials such as homopolymers and copolymers of polyolefins, polyamides, polyesters or other material that are capable of being sealed using standard conduction sealing techniques. The sidewalls may be multilayered or single layered and may be fabricated from any suitable polymer processing technology including extrusion, coextrusion, extrusion lamination, lamination or other. The container can be made from individual sheets placed in registration and sealed along the periphery 14 or can be made from a blown film process where only opposing ends of a tube need be sealed to complete the container 10.

Figure 3:
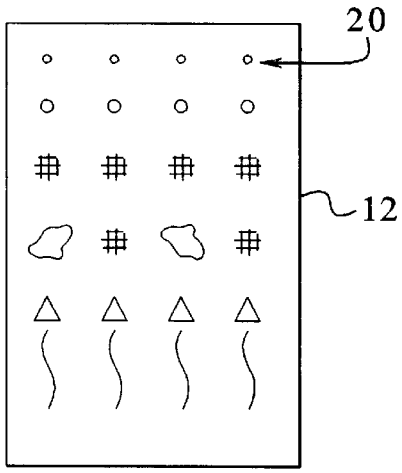
FIG. 3 is a sidewall of the container of FIG. 1 having objects having varying shapes.

FIG. 3 shows a plurality of objects 20 on the sidewall 12. The objects 20 can be positioned on a single sidewall or both. The objects, in a preferred form of the invention, are provided over an entire surface of the sidewall but could be provided only in select areas of the surface. The objects can be of any shape including regular shapes such as circular, polygonal, straight or curved lines, symbols or the like. The objects can also be irregular shaped. These objects 20 assist in draining fluid from the chamber 16. The objects 20 can be raised protuberances or indentations in these shapes. The objects can be all of the same shapes or be of a combination of shapes. The objects can be of varying sizes provided the objects are effective to provide fluid pathways through the container when the fluid or particulate contents of container is being evacuated.

The objects 20 can form a regular pattern or an irregular pattern. The regular pattern includes objects being placed at the same or essentially the same spacing or a repeating sequence of spacings. The irregular pattern is one where the objects are generally randomly distributed.

Figure 4:
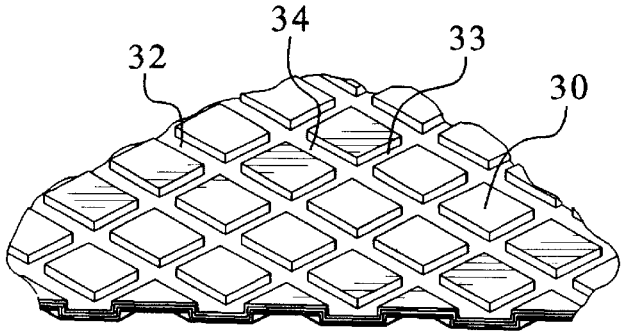
FIG. 4 is a sidewall of the container of FIG. 1 having a plurality of regularly spaced rectangular protuberances to define a checkerboard pattern.

In a preferred form of the invention as shown in FIG. 4, a regularly spaced pattern of rectangular-shaped objects 30 having pathways 32 defined therebetween. This checkerboard pattern has at least a first pathway 33 intersecting a second pathway 34. In a preferred form of the invention the pathways intersect at substantially perpendicular to one another. However, it is contemplated the intersection of pathways 32 can for various angles without departing from the present invention.

Figure 5:
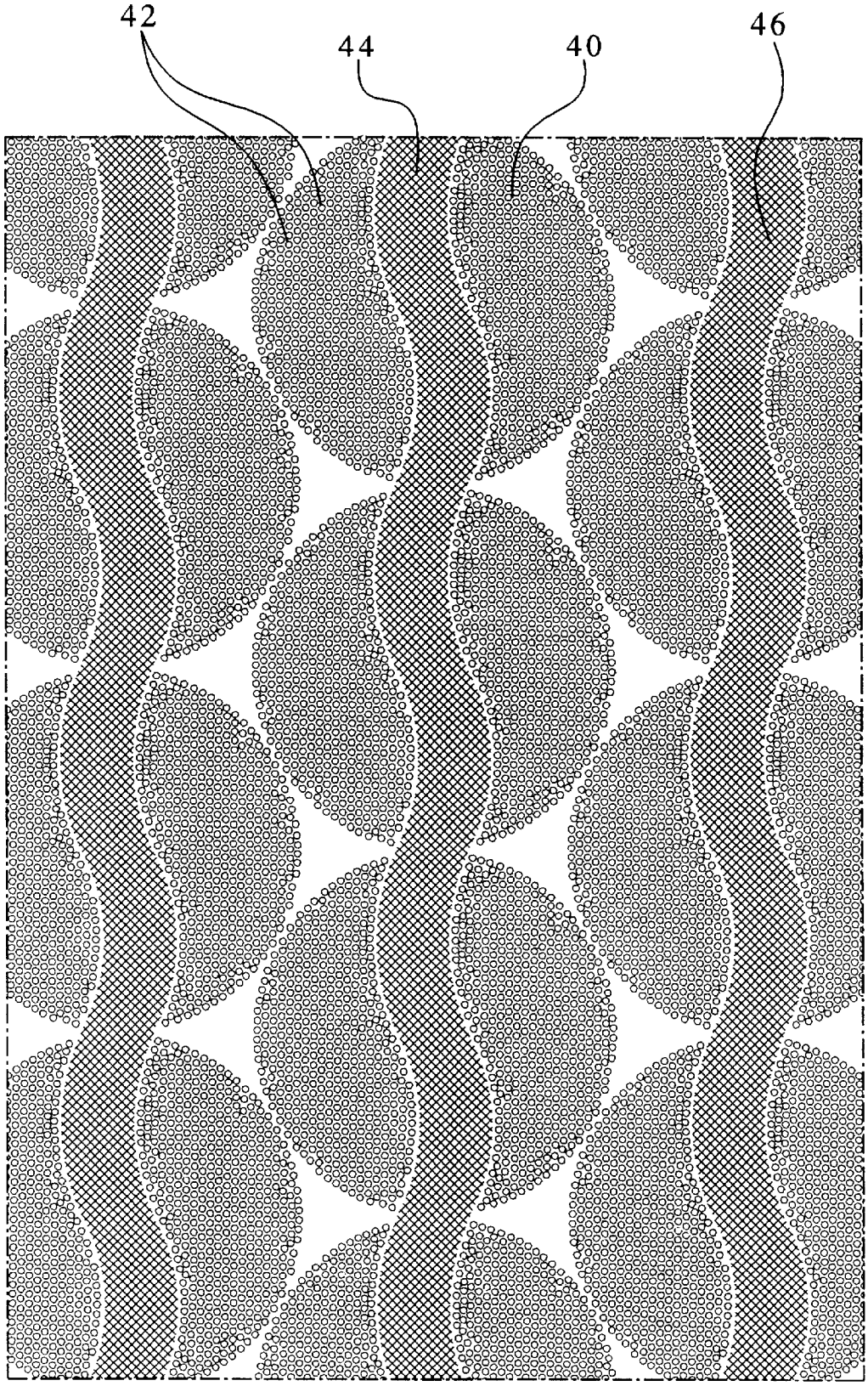
FIG. 5 is a sidewall of the container of FIG. 1 having circular protuberances together forming a circular pattern with a series of X-shaped protuberances forming S-shaped lines and further forms a trademark owned by the Pepsi-Cola Company.

FIG. 5 shows another preferred form of the invention having a series of circular protuberances 40 together with X-shaped protuberances 44. The circular protuberances 40 define a circular shape 42. The X-shaped protuberances 44 define a S-shaped pattern 46. Of course it is contemplated that any combination of shapes of protuberances can be used and that more than two different shapes can be used. The present invention further contemplates that the individual protuberances can form varying indicia such as a trademark, tradename, logo, instructions for use or other identifying or useful information or advertising that can be viewed through the sidewall 12 or 14 or both.

The objects can be formed on the inner surface of sidewall 12 or sidewall 14 or both by techniques well known in the art including embossing during the fabrication of the sidewall, or embossing afterwards. The pattern can also be applied by an extrusion coating process or similar process. The objects can be pressed into the sidewalls with a shaped die. Numerous other mechanisms and processes come to mind for forming the objects which are well known in the art and the present invention should not be limited to these processes recited.

The fitment 18 has an opening 50 having an axis essentially perpendicular to the sidewall 12 of the container. It is contemplated the fitment 18 can be mounted at various angles to the sidewall without departing from the present invention. The fitment 18 provides fluid access to the contents of the chamber 16. Typically, container 10 is used for housing liquids such as soft drink syrup which are withdrawn from the container under pressure with a hose and mixed at a fountain with a diluent such as soda water. The hose (not shown) has an attachment for connecting to the fitment in a fluid and air tight arrangement. A vacuum pressure is applied to the fitment 18 through the hose to withdraw fluid under pressure from the container.

Of course, the fitment 18 may be attached to the first or second sidewall 12, 13 or both and may be located at any location thereon.

The present invention further provides a process for evacuating the container shown in FIG. 1. The method for evacuating a fluid from a container comprises the steps of: (1) providing a liquid filled container having a sidewall having an inner surface; (2) providing a plurality of objects on the inner surface of the sidewall to define a plurality of channels having at least a first channel and a second channel intersecting one another; (3) providing a fitment attached to an outer surface of the sidewall, the fitment having an opening therethrough having an axis substantially perpendicular to the outer surface; and (4) applying a suction to the fitment to draw fluid from the container.

While the specific embodiments have been described, numerous modifications come to mind without significantly departing from the spirit of the invention and the scope of protection is only limited by the scope of the accompanying claims. This design is just one example of a pattern design having these favorable characteristics, and disclosure of it is merely one example of a design having its favorable characteristics, others of which are not significant departures from the spirit of the invention.

I claim:

1. A flexible polymeric container for storing and dispensing liquids comprising: a first sidewall and a second sidewall connected together to define a fluid chamber therebetween, the first sidewall and the second sidewall each having an inner surface facing the fluid chamber and an opposed outer surface; an access member for accessing the fluid chamber; and a plurality of a first set of objects having a first shape on the inner surface of one of the first sidewall or the second sidewall; and a plurality of a second set of objects having a second shape different from the first shape and positioned on the inner surface of one of the first sidewall or the second sidewall.

2. The container of claim 1 wherein the first set of objects and the second set of objects are on the same sidewall.

3. The container of claim 1 wherein the first set of objects is a plurality of spaced protuberances.

4. The container of claim 1 wherein the access member is a fitment attached to an outer surface of the first sidewall or the second sidewall.

5. The container of claim 1 wherein the fitment has an opening with an axis substantially perpendicular to the sidewall.

* * * * *